United States Patent [19]

King

[11] 4,344,256

[45] Aug. 17, 1982

[54] DOOR WITH VARIABLE HINGE LOCATIONS

[75] Inventor: Clarence H. King, Grosse Pointe Woods, Mich.

[73] Assignee: Copco Door Company, Warren, Mich.

[21] Appl. No.: 217,476

[22] Filed: Dec. 17, 1980

[51] Int. Cl.[3] ..... E06B 3/00

[52] U.S. Cl. ..... 49/501; 49/399

[58] Field of Search ..... 49/501, 503, 599, 399, 49/382; 52/802

[56] References Cited

U.S. PATENT DOCUMENTS

| | | | |
|---|---|---|---|
| 2,605,869 | 8/1952 | Backman | 49/399 X |
| 2,853,162 | 9/1958 | David et al. | 49/399 X |
| 2,948,366 | 8/1960 | Kelly et al. | 49/399 X |
| 3,186,528 | 6/1965 | Bohnsack | 49/503 |
| 4,087,942 | 5/1978 | Herrmann | 49/501 |

*Primary Examiner*—Philip C. Kannan

*Attorney, Agent, or Firm*—Krass, Young & Schivley

[57] ABSTRACT

A replacement door which accommodates a wide variety of existing hinge spacings on a door jamb. The door includes a frame with at least one continuous hinge channel member. The channel member includes a plurality of offset sections spaced along its length. The offset sections are substantially longer than the length of commonly used hinges to thereby span the range of normally encountered hinge locations. Front and rear skins are connected to the frame with the edges of the skins being supported by the major surface of the hinge channel. Segments of the skins in an alignment with existing hinge locations may be removed to expose selected portions of the offset sections for flush mounting of the hinges. The elongated offset sections permit the use of the door structure as a common replacement for doors having a wide variety of hinge spacings.

11 Claims, 3 Drawing Figures

DOOR WITH VARIABLE HINGE LOCATIONS

BACKGROUND OF THE INVENTION

The invention relates to building materials and more particularly to doors.

Metal replacement doors are used in a wide variety of applications. Some are used to replace wooden doors in old buildings while others are used in stairwells to comply with fire safety regulations. Still other applications are well known to those in the industry.

It would be advantageous to use the same hinges for the replacement doors that were used in the existing door structures. However, while the size and length of the hinges are generally uniform there is no standard spacing between the several hinges on the door jamb. Very often the existing hinge spacings do not align with the hinge attachment locations on the replacement doors. In the metal door structures of the prior art, such as those shown in U.S. Pat. No. 2,853,162 to David et al and U.S. Pat. No. 2,948,366 to Kelley et al, the hinge attachment locations are of a size to exactly match the standard hinge lengths. Thus, if the hinge attachment locations on the replacement doors do not match the existing hinge spacings, the hinges had to be moved on the door jamb into alignment. This requires that the user cut out new mounting surfaces for the hinges and drill new holes for screwing the hinge plates into their new locations. Unfortunately, this leaves unsightly holes and deformations where the old hinges have previously been.

SUMMARY OF THE INVENTION

The door of the present invention solves these problems by providing unique hinge attachment means on the hinge channel of the replacement door. The hinge channel includes offset hinge attachment areas which are substantially longer than a standard hinge. This allows the old hinges in their existing positions to be used in mounting the replacement door. When the door is purchased, the attachment means of the door are covered by an outer skin. The installer determines where the hinges are to be placed on the door and removes as much of the skin opposite the elongated attachment areas as is necessary to attach the existing hinges.

Preferably, the hinge attachment means takes the form of a continuous channel member having a major outer surface and a plurality of offset sections inboard of said major surface spaced along the length of the member. The length of the offset sections are chosen to span the range of normally encountered hinge locations on existing doors. The front and rear covering skins are connected to the frame with the edges of the skins being folded around the end of the door to substantially cover the channel member. The major surface of the channel member supports the skins and prevents them from being dented. After selected portions of the skins have been removed, the remaining skins serve to cover the unused portions of the offset sections in the channel member to provide a pleasing appearance.

BRIEF DESCRIPTION OF THE DRAWINGS

These and other objects and advantages will become apparent upon reading the following specification and by reference to the drawings in which.

DESCRIPTION OF THE PREFERRED EMBODIMENT

Figure 1:
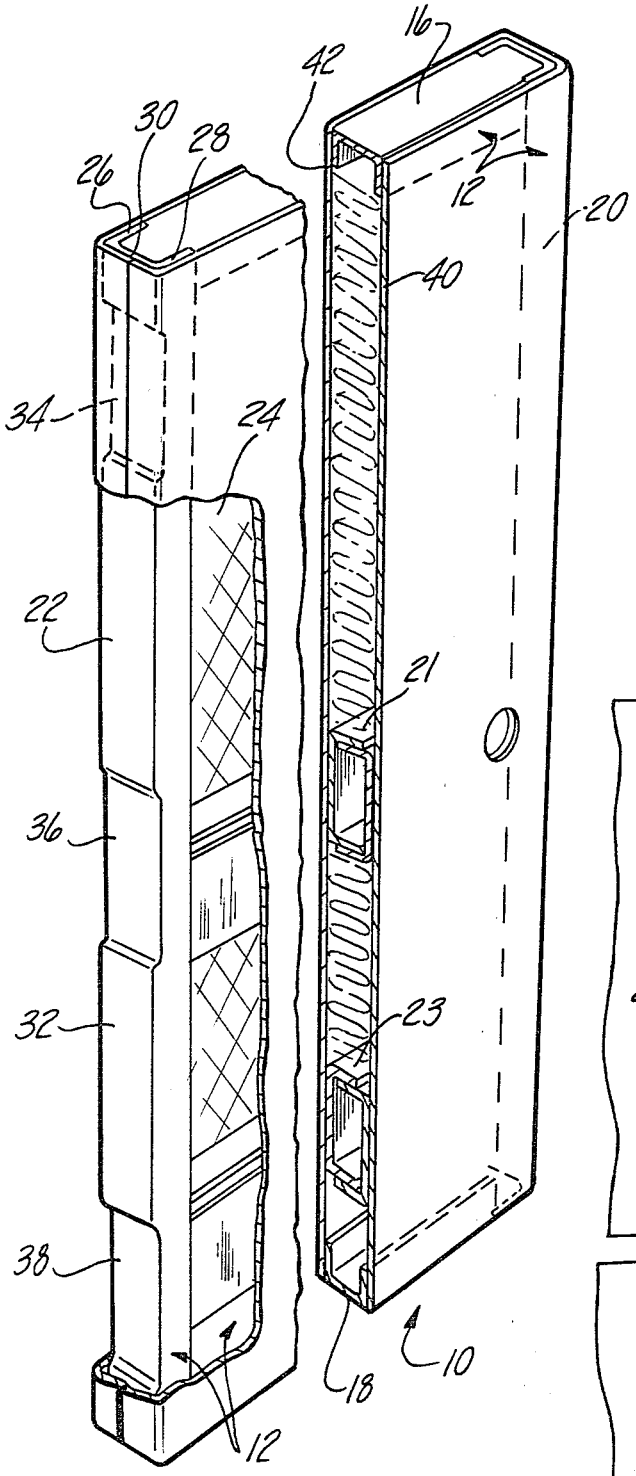
FIG. 1 is a perspective view with parts cutaway of the preferred embodiment of this invention.

Referring now to the drawings, especially FIG. 1, door 10 includes a peripheral frame generally designated by the numeral 12. Frame 12 includes upper and lower channel members 16, 18, respectively, which are connected to vertical channel members 20, 22, respectively. The channel members each generally take the shape of U-shaped bars of heavy guage steel. The inner confines of frame 12 is preferably filled with a cardboard honeycombed reinforcement matrix 24. Various types of reinforcement materials and/or insulating materials may be alternatively used. Laterally extending reinforcement channels 21, 23 may be also used to add further reinforcement and rigidity to door 10 although they are likewise not necessary to practice this invention.

Special attention should be drawn to member 22 which shall be referred to as the hinge channel member. Member 22 runs the entire vertical length of door 10 and is defined by two spaced inwardly projecting flanges 26, 28 bridged by a web portion 30. Web portion 30 includes a generally flat major surface 32 which is interrupted at three very important offset sections 34, 36, and 38. Each of the offset sections is spaced inwardly from major surface 32 about 0.12–0.20 inch, preferably about 0.200 inch. Advantageously, offset sections 34, 36, and 38 are embossed in surface 32 of member 22 and extend completely across the width of web 30. The length of offset sections 34, 36 and 38 are chosen to be at least 50% and preferably more than 100% or twice the length of standard hinges. Standard hinges are generally about 4½ inches in length whereas the length of the offset sections in this embodiment are 8–12 inches, more particularly about 10 inches. The centerline of the middle offset section 36 is substantially centrally located. The centerline of the upper and lower sections 34 and 38 are spaced about 8–12 inches from the top and bottom of door 10, respectively.

Door 10 is provided with a front skin 40 and a rear skin 42. The vertical edges of skins 40 and 42 are folded around the corners of hinge channel member 22 into substantially abutting relationship centrally along the length of web 30 of member 22. Skins 40, 42 can be permanently attached to frame 12 by a variety of methods. Preferably, the skins are projection welded along the flanges of the U-shaped frame members. It is important to note that at least the hinge channel member 22 is completely covered by the skins and that the major flat surface 30 of channel member 22 provides a supporting surface for the edges of the skins.

Figure 2:
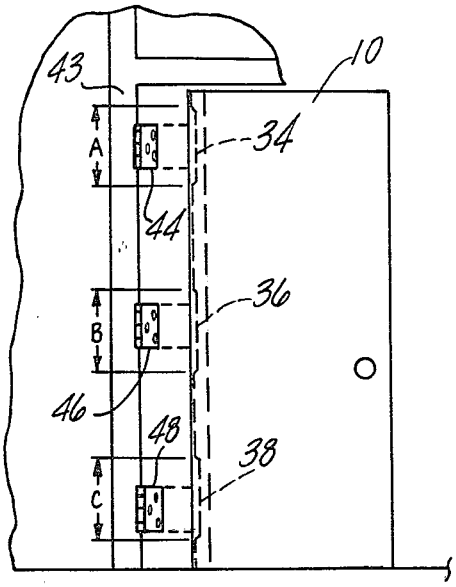
FIG. 2 is a front view of the preferred embodiment shown next to a door jamb with existing hinges.
Figure 3:
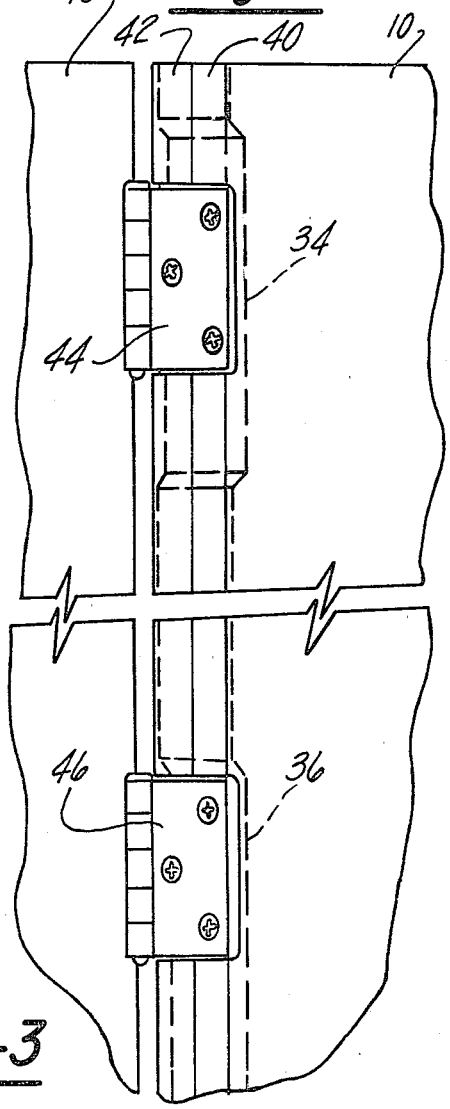
FIG. 3 is a fragmented side view showing the hinges mounted on the door of the preferred embodiment.

Referring now to FIGS. 2 and 3, a method of utilizing the replacement door of the present invention will now be described. In FIG. 2 there is shown a door jamb 43 with existing hinges 44, 46 and 48. The hinges are of conventional design and includes two plates pivoting about a rod or pintle. The user measures the existing spacing between the hinges and places appropriate marks on the hinge side of the door to conform with the measured hinge spacings. It can now be readily appreciated that the door 10 with its elongated offset hinge attachment sections 34, 36 and 38 can accommodate a wide variety of hinge spacings. The location of hinge 44 can be anywhere within the range noted at A and still be used in its existing location to attach the door. Likewise, hinges 46 and 48 can be within any of the ranges noted at B and C, respectively.

After the existing hinge spacings are marked, selected portions of the outer skins 40 and 42 are cut-away as shown in FIG. 3. In the drawing door 10 is shown angled with respect to jamb 43 in order to better illustrate the attachment of the hinges. Each of the removed sections of the skins exposes an area of the underlying offset portion which corresponds in length to its associated hinge. The remaining portions of the skins serve to cover the unused portion of the offset sections to provide a continuous and aesthetically pleasing appearance. Holes are tapped into the offsets to conform with the screw hole pattern in the existing hinges. The plates of hinges 44, 46 and 48 are then screwed into the holes in the off-set sections 34, 36 and 38, respectively. The depth of the offset sections are chosen such that the outer surface of the hinge plate is flush with the door skin. If the thicknesses of the hinge plates are slightly smaller than the depths of the offset sections, shims may be used to bring the hinges out flush with the skins.

Thus it can now be realized that the present invention provides a substantial improvement in the metal door field. The same door can be used to accommodate a wide variety of existing hinge spacings. The user is not required to remove and remount the hinges to match the unforgiving conforming attachment sections of the prior art doors. Additionally, the cooperation between the unique framing arrangement and the skins of the door facilitates the efficient production of a rugged structure which can withstand substantial abuse. While the present invention finds particular utility as a replacement door, it of course can be utilized as original equipment.

Therefore, while this invention has been described in connection with a particular example thereof, other modifications will become apparent to one skilled in the art after studying the drawings, specifications and the following claims.

I claim:

1. A door structure which accomodates hinges of a given length spaced at a wide variety of spacings on a door jamb, said door comprising:

a frame including at least one continuous hinge channel member having a major outer surface, a plurality of offset sections inboard of said major surface spaced along the length of said member, said offset sections being substantially longer than the length of said hinges and spanning the range of normally encountered locations of the hinges on the door jamb, front and rear skins connected to the frame, with edges of said skins being supported by the major surface of said member whereby segments of said skins in alignment with existing hinge locations may be removed to expose selected portions of said offset sections for substantially flush mounting of the hinges.

2. The door of claim 1 wherein said offset sections are at least 50% longer in length than the given lengths of said hinges.

3. The door of claim 1 wherein said given length of the hinge is about $4\frac{1}{2}$ inches and wherein the lengths of said offset sections are about 10 inches.

4. The door of claim 1 wherein said offset sections are about 0.12–0.20 inches deep.

5. The door of claim 1 wherein said offset sections are at least as deep as the thickness of said hinges.

6. The door of claim 1 wherein said channel member is U-shaped with a web bridging spaced flanges, said offset sections being located on the web.

7. The door of claim 2 wherein said skins are welded to the flange portions of the channel member.

8. The door of claim 6 wherein opposing edges of said front and rear skins are substantially abutted along the length of said web to initially cover the offset sections.

9. The door of claim 6 including three offset sections embossed in the web of said member.

10. The door of claim 9 wherein the centerline of upper and lower offset sections are spaced about 8–12 inches from the top and bottom of the door, respectively; the middle offset section being substantially centrally located.

11. A replacement door for use with existing hinges of about $4\frac{1}{2}$ inches in length mounted at a wide variety of locations on a door jamb, said door comprising:

a frame including at least one continuous U-shaped hinge channel member having two inwardly projecting flanges bridged by a web, said web having a major outer surface, a plurality of offset sections embossed in the major surface of said web and spaced along the length thereof, said offset sections being about 10 inches in length, front and rear skins covering the frame, edges of said skins being folded around the channel with opposing edges being substantially abutted along the length of said web, whereby segments of said skins in alignment with existing hinge locations may be removed to expose selected portions of said offset sections for substantially flush mounting of said hinges, the elongated offset sections permitting the use of the door structure as a common replacement for doors having a wide variety of hinge spacings.

* * * * *